US005437164A

United States Patent [19]

Consiglio

[11] Patent Number: 5,437,164

[45] Date of Patent: Aug. 1, 1995

[54] SET FOR ATTACHING AIR-CONDITIONING COMPONENTS

[75] Inventor: Ettore S. Consiglio, Joinville - SC, Brazil

[73] Assignee: Consul S.A., Joinville - SC, Brazil

[21] Appl. No.: 197,349

[22] Filed: Feb. 16, 1994

[30] Foreign Application Priority Data

Feb. 17, 1993 [BR] Brazil ..... 9300416

[51] Int. Cl.[6] ..... F25D 23/12

[52] U.S. Cl. ..... 62/259.1; 62/285; 62/262; 138/40; 138/44

[58] Field of Search ..... 62/262, 263, 285, 279, 62/259.1; 138/39, 40, 43, 44

[56] References Cited

U.S. PATENT DOCUMENTS 3,724,233 4/1973 Pugh et al. ..... 62/262
4,800,734 1/1989 Sauber et al. ..... 62/263

*Primary Examiner*—John M. Sollecito

*Attorney, Agent, or Firm*—Darby & Darby

[57] ABSTRACT

Set for attaching air conditioner components, including a base (10), which has: component attaching ribs (11); at least two component seating pads (12, 13); and a water drain (21, 22, 24). The base (10) is made of a single piece, incorporating: the component attaching ribs (11) which are disposed on the surface of the base (10); the component seating pads (12, 13) being each defined by a solid piece, shaped for the seating of a respective component (60, 70), the water drain (21, 22, 24) being adequately disposed in fluid communication relative to each other, in order to provide the draining of the undesirable water deposits from the base (10). There is also incorporated, in a single piece, a condenser tube positioning element (27), disposed to provide adequate positioning for mounting a condenser (40), and provided in a single piece is at least one compressor spacing element (51), disposed to receive and retain in a determined position, a respective element for attaching a compressor (50).

15 Claims, 6 Drawing Sheets

SET FOR ATTACHING AIR-CONDITIONING COMPONENTS

FIELD OF THE INVENTION

The present invention relates to a set for attaching air-conditioner components, which presents high resistance, easy handling, long service life and which is interchangeable with similar sets that are presently used.

BACKGROUND OF THE INVENTION

The known air conditioners have sets for the attachment of components constructed in multiple pieces and comprising a metallic base, which is formed by a plate, which is zinc coated and painted, carrying a plurality of component attaching means in the form of lugs, which are also made of zinc coated metal, attached by means of spot welding and perforated, in order to allow the attachment of the respective components of the appliance through bolts. For attaching the motor-fan and the ventilating chamber to the base, there are provided component supporting means, each having the form of a metallic profile, which is substantially horizontal and which is secured by bolts to at least one lug, or bolted directly to the base, and to which the motor-fan or the ventilating chamber is seated and bolted. In the assembly of the compressor, in order to avoid smashing of the rubber damper when said compressor is bolted, there is provided at least one compressor spacing element, in the form of a steel tubular cylinder, which is inserted in the rubber damper and inside which a respective bolt is introduced.

Considering that at the welding spot of each lug there occurs loss of the zinc coated material, i.e., the anticorrosive protection, it is noted that the known set for attaching the air-conditioner components is highly susceptible to the severest type of corrosion, i.e., at each welding spot that loses the zinc protective layer, the base is subjected to a punctiform corrosion.

The water draining system, which consists of: evaporator water collector, water draining duct and condenser water collector, presents in the state of the art a complex and very inefficient construction. The evaporator water collector presents the form of an upperly opened container, which is fitted between the base front wall and the evaporator spacing means [see FIG. 2, reference C 01] and which is provided, at its rear wall, with a drain, to which the water draining duct is connected in the form of a rubber hose. The condensing water from the evaporator, as collected in said evaporator water collector, is conducted through the rubber hose towards the condenser water collector. The latter, which is formed by a recess defined at the rear portion of the base, receives the water that has condensed on the surface of the evaporator, as described above. At the rear wall of the base, i.e., of the condenser water collector, there is provided an orifice, onto which a multiple-piece drain is mounted, as described henceforth, and through which the collected water flows.

The water draining system, as described above, besides being subjected to cloggings at the draining hose of the evaporator water collector, therefore causing frequent overflows to the environment served by the appliance, is not designed for supporting the pluvial water received by the lateral portions of the base. Such water, besides in certain cases increasing the above cited overflows, can be found throughout the base surface, causing a general corrosion on the latter, as well as risks of short circuits when in contact with the electric system. Moreover, in the known draining system, the sides and the bottom of the condenser are usually immersed in the water contained in the collector, thus being subjected to corrosion. It is also common to have overflow of water from the condenser water collector, due to cloggings in the drain, caused by the surface tension of the water.

Besides the problems related to corrosion and electrical breakdowns, the known set for attaching the air conditioner components further presents other inconveniences, such as the construction and handling complexity, as well as high vulnerability to process damages and failures during the construction operations and the assembly of the air conditioner.

The construction and handling complexities of the sets for attaching the air conditioner components of the present state of the art, besides involving the above cited operations of painting and welding the lugs and bolts, require, among others, shaping and finishing operations, such as bendings, sandings and impermeabilizations, for example by applying sealing elements between the base and the front spacer of the appliance, after the mounting thereof.

As to the vulnerability of said sets to damages, it should be noted the problems, such as, for example, dents in the lugs, base distortions, scratches in the paint and/or in the zinc coating layer, which problems, besides others which were omitted, may cause the manufacturer to scrap complete base sets, thereby often requiring, before the scrapping, additional operations for dismounting the appliances, which have already been mounted.

Common failures during the assembly of the known sets for attaching the air conditioner components include mispositioning of the lugs for the welding and of the appliance components during the mounting-thereof. In the first problem cited, it is common in the extreme situation in which it is necessary to discard the entire base set; in the second case, multiple operations for dismounting, repositioning and remounting the appliance components are needed.

It can be easily observed that the numerous inconveniences cited above involve high costs, either to the manufacturer or to the user of the appliance, since said inconveniences impair the productivity of the amount of parts mounted, in relation to the amount of the used raw material and to the average time for producing one unit, on the manufacturer's side, and the duration of the appliance, on the user's side.

Besides the inconveniences cited above, the set for attaching the air conditioner components further presents restrictions in the construction of its draining system. Since the mounted drain projects beyound the base, and in order to protect said drain and the base against damages during the transportation and assembly, the draining system is provided in separate parts, to be mounted when the appliance is installed. Moreover, as already stated, due to the surface tension of the water, the known drain does not often drain the water and the water layer in the condenser water collector increases beyond the level of the drain, thereby covering portions of said condenser.

DISCLOSURE OF THE INVENTION

Thus, it is an object of the present invention to provide a set for attaching air conditioner components, which has a simple construction and which requires a minimum amount of mounting steps.

It is a further object of the present invention to provide a set for attaching air conditioner components, as described above, which is highly resistant to corrosion.

It is a further object of the present invention to provide a set for attaching air conditioner components, as described above, which permit obtaining a high productivity in the mounting of the appliance, with a minimum loss of material due to damages or handling failures.

These and other objectives and advantages of the present invention are achieved through the provision of a set for attaching air conditioner components, including a base, which comprises: component attaching means; at least two component seating means; and water draining means, wherein the base is made of a thermoplastic or thermoset material, incorporating, in a single piece, the component attaching means, defined by a plurality of ribs, which are adequately disposed on the surface of said base, the component seating means being each defined by a solid piece, which is adequately shaped to seatingly receive a respective component, the water draining means being adequately disposed in fluid communication relative to each other, in order to provide the draining of the undesirable water deposits from said base, there also being incorporated, in a single piece, positioning means for the condenser tubes, which are disposed so as to provide an adequate positioning for mounting the condenser, there further being provided in a single piece at least one compressor spacing means, which is disposed so as to receive and retain in a determined position a respective element for attaching the compressor.

In practical terms, the use of the present invention provides the manufacturer of the air conditioner with a substantially simplified construction, which results in a substantial increase in the productivity of its assembly lines, with a reduction in the loss of raw material and in the amount of discarded material, said benefits being followed by corresponding gains in terms of costs and quality.

To the consumer, it provides a product of better quality, which is easier to install, handle and maintain, and which also has a longer useful life, at a cost at least equal or even lower than that of the air conditioner produced with the traditional attaching set.

BRIEF DESCRIPTIONS OF THE DRAWINGS

The invention will be described below, with reference to the attached drawings, in which.

DETAILED DESCRIPTION OF THE INVENTION

Figure 1:
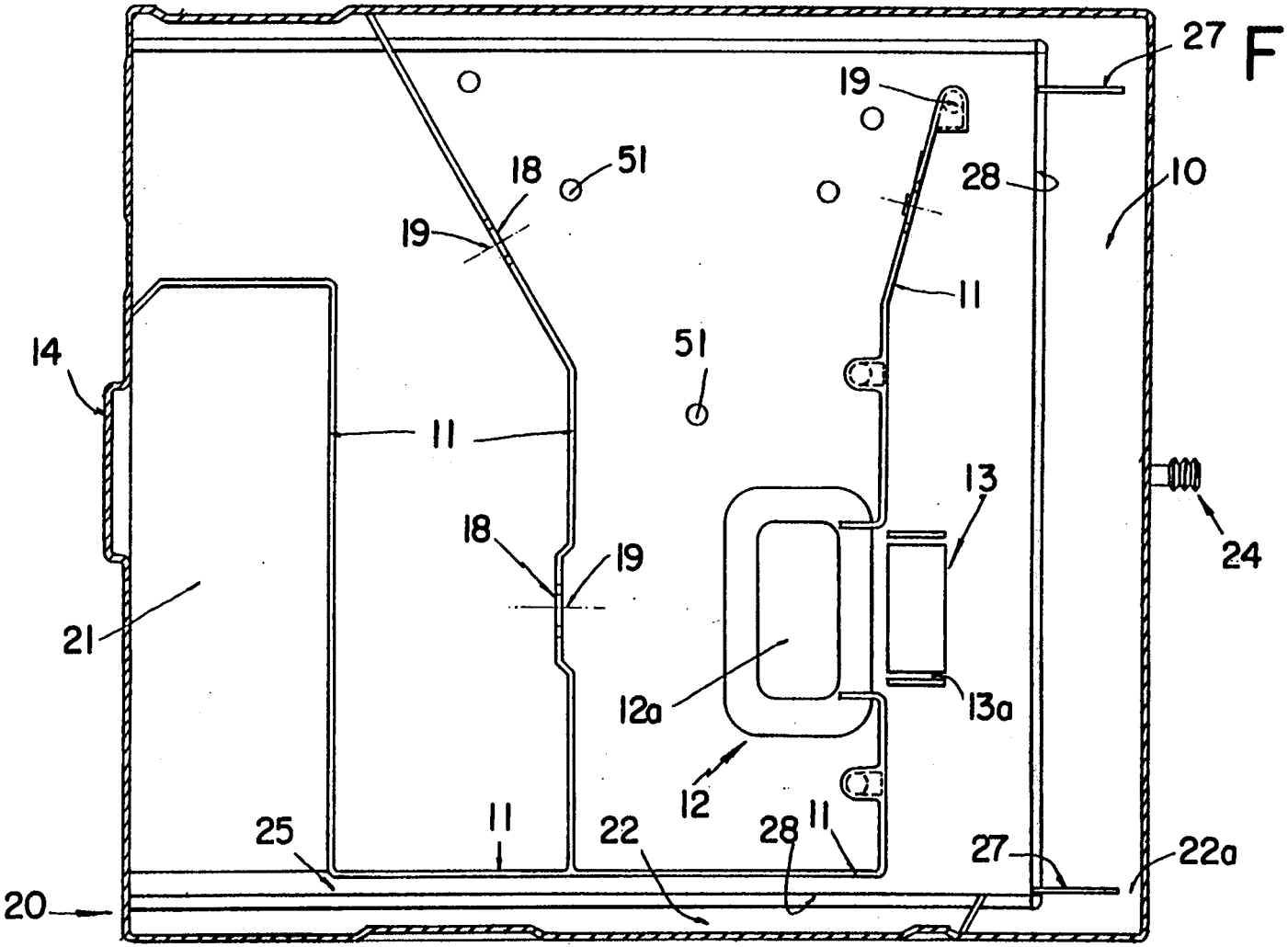
FIG. 1 is a plan upper view of the base of the set of the present invention.
Figure 2:
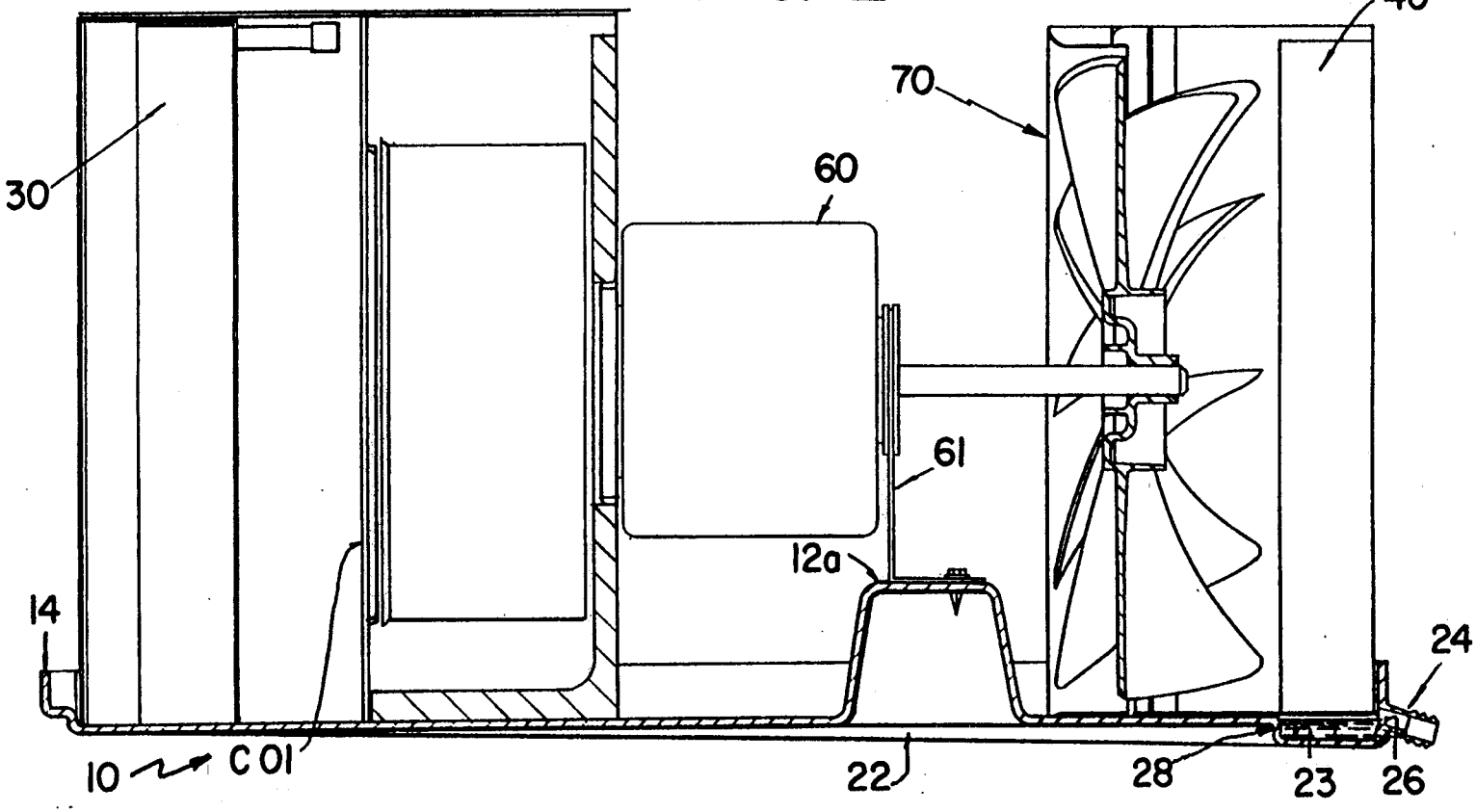
FIG. 2 is a vertical transversal sectional view of the set of the present invention, further presenting the dispositions of the various components of the air conditioner, mounted to said set.
Figure 3:
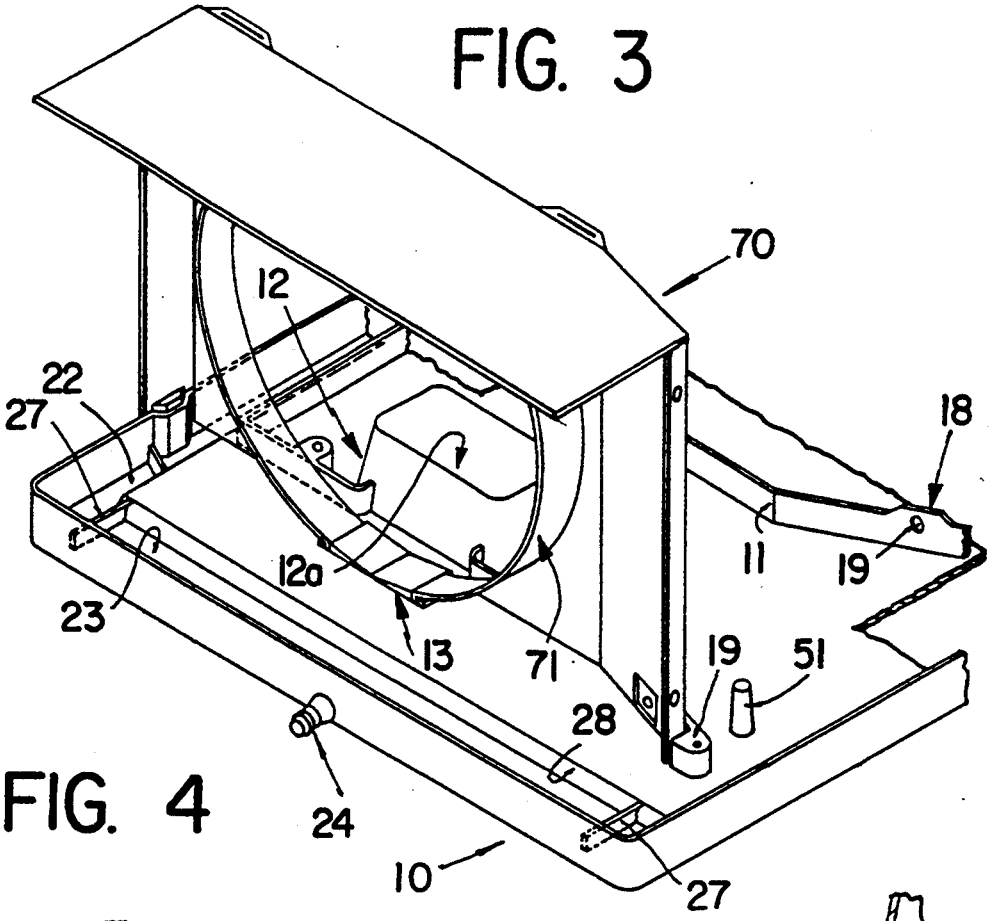
FIG. 3 is a lateral-rear perspective view of a ventilating chamber mounted to the base.
Figure 4:
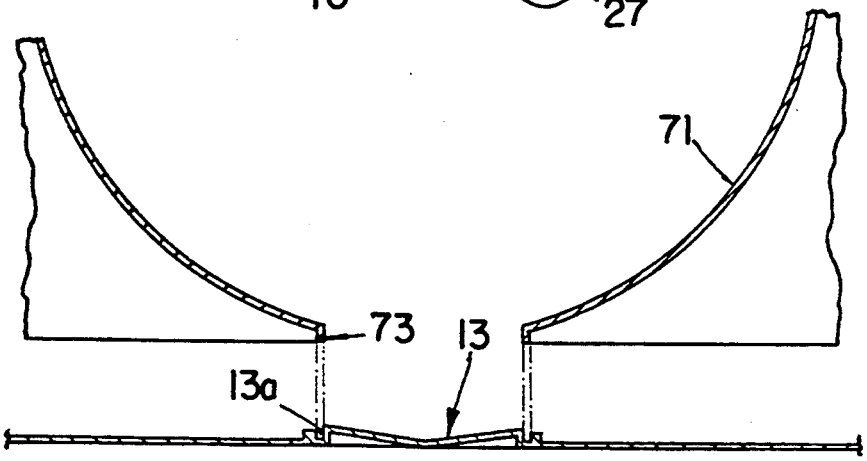
FIG. 4 is an exploded sectional view of an enlarged detail of the support for the ventilating chamber of the present invention.
Figure 5:
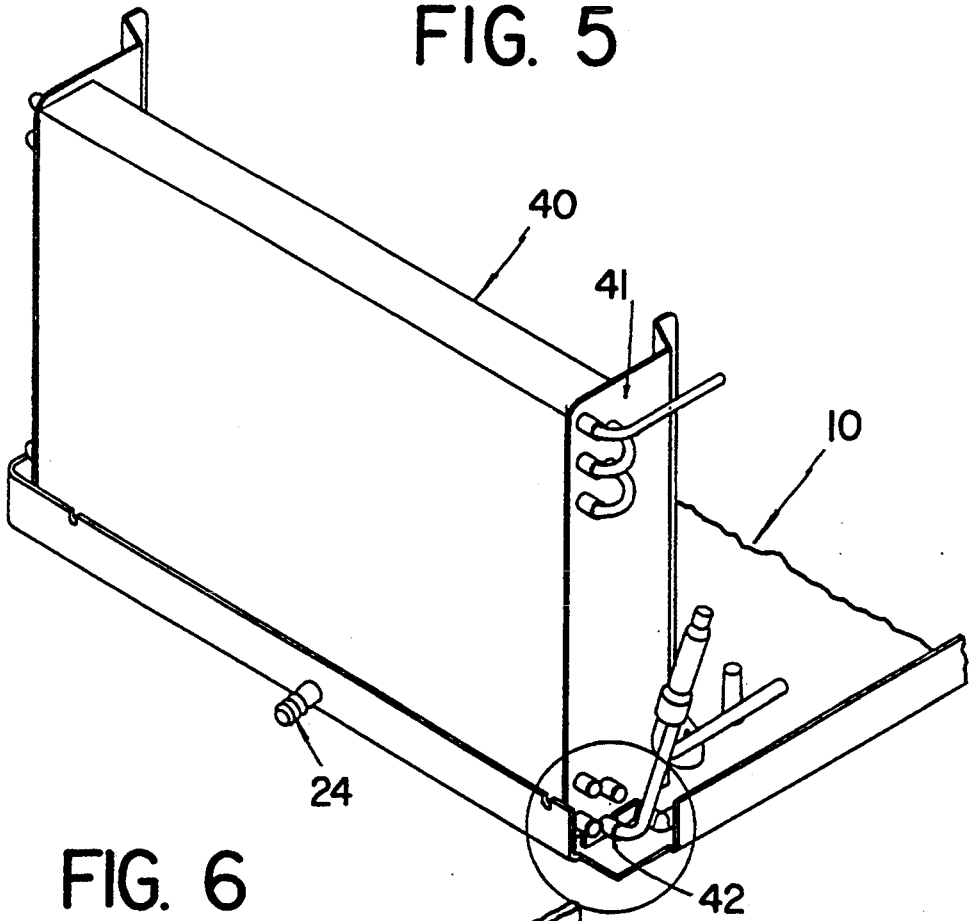
FIG. 5 is a view similar to that of FIG. 3, showing a condenser mounted to the base and positioned with the help of the positioning means of the condenser tubes of the invention.
Figure 6:
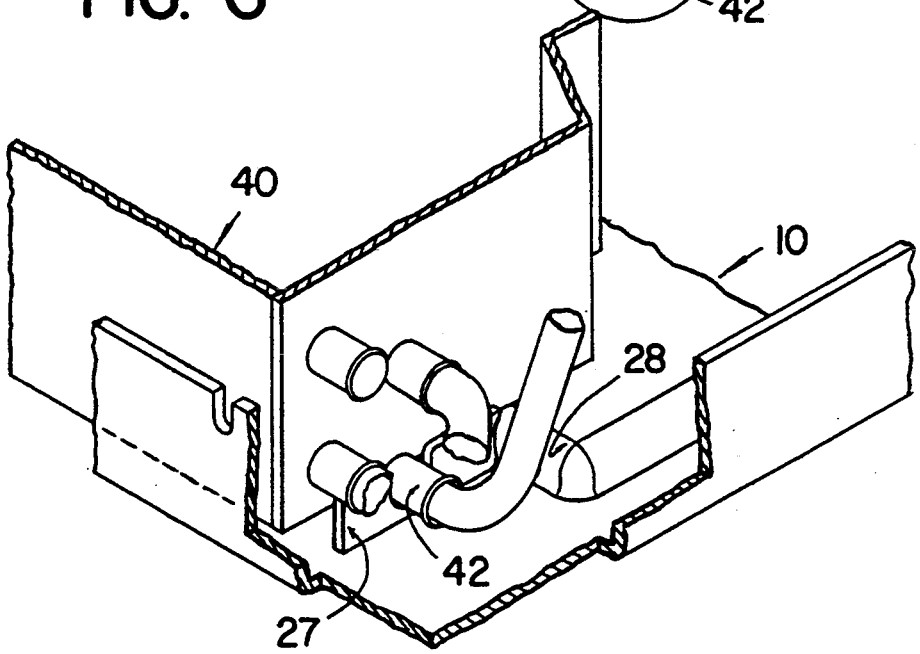
FIG. 6 is an enlarged view of the detail that is circled in FIG. 5.
Figure 7:
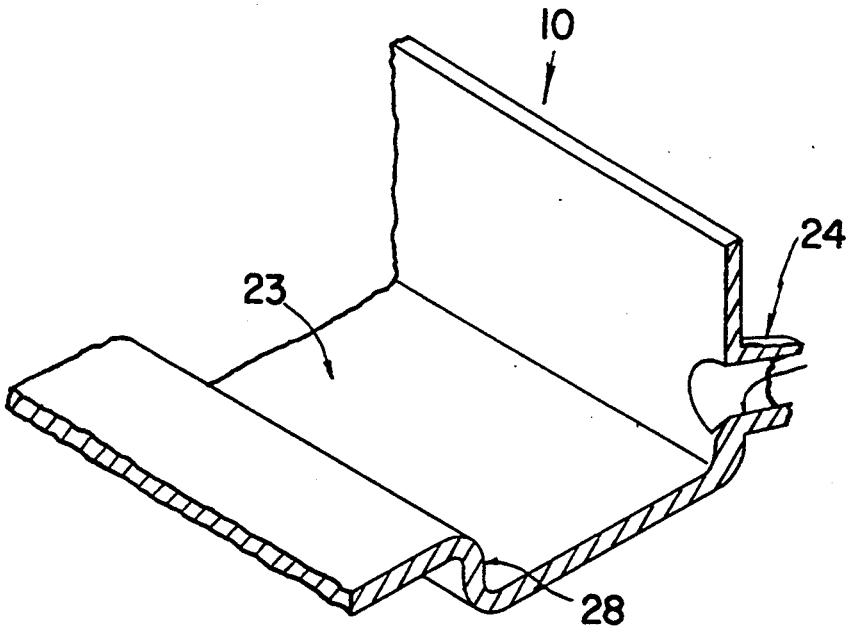
FIG. 7 is a partially cut perspective view of the longitudinal incorporated to the drain of the present invention.
Figure 8:
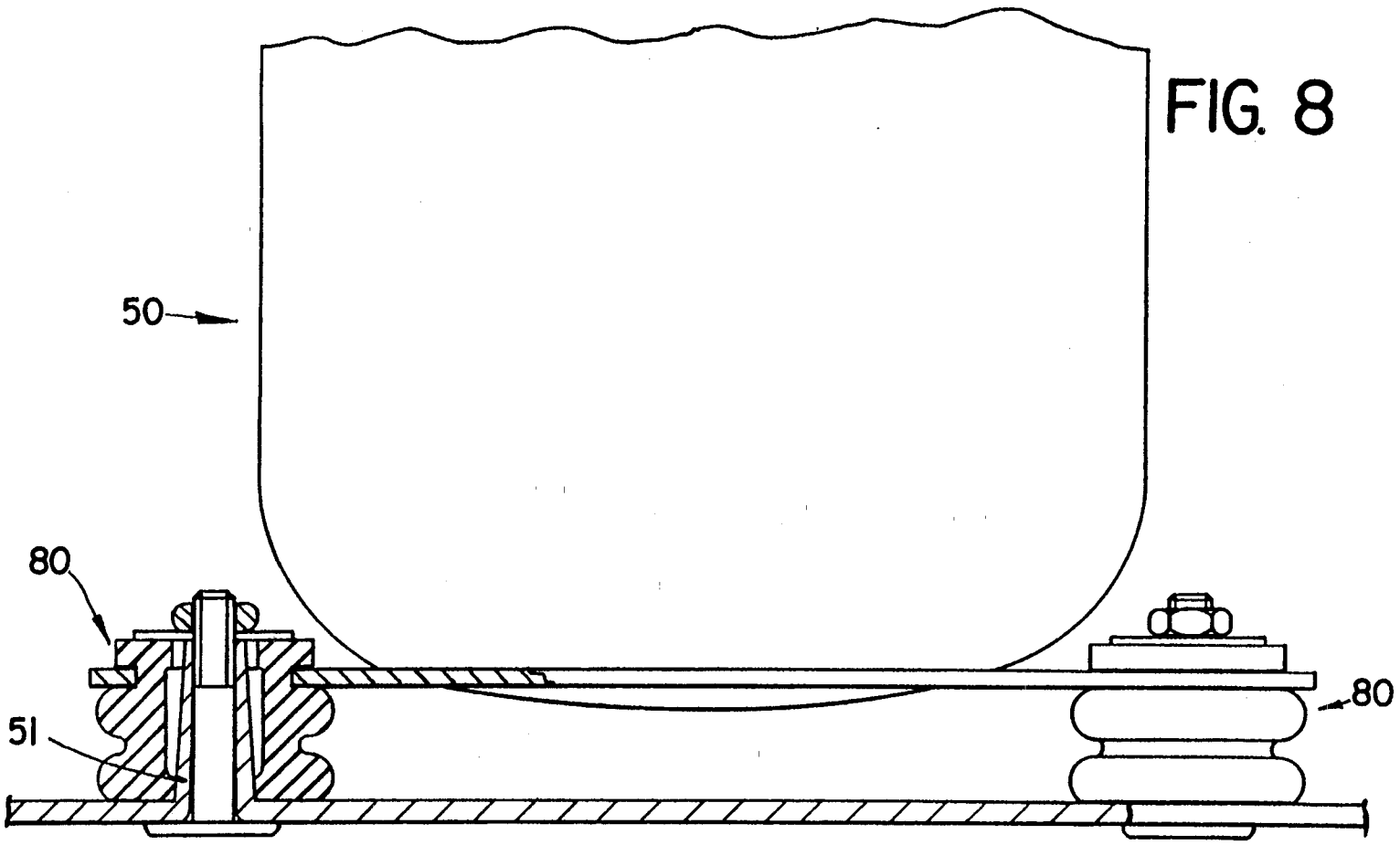
FIG. 8 illustrates, in a schematic sectional view, the assembly of the compressor onto the rubber dampers

According to the figures described above, the set for attaching air conditioner components of the present invention is of the type including a base 10, which is formed of a thermoplastic or thermoset material and which incorporates in a single piece: a plurality of component attaching means 11, at least two component seating means 12, 13, a draining system 20, including an evaporator water collector 21, a draining duct 22, a condenser water collector 23 and a drain 24.

The component attaching means 11 are preferably defined by ribs, each being disposed so as to replace at least one metallic lug of the prior art construction, said ribs being therefore provided with reinforcing means 18 and with the necessary perforations 19 at the attaching points of the components, the attachments being preferably effected through bolting.

Besides serving to attach the components, said ribs further have the function of reinforcing the base 10 and retain the water that may eventually be generated from the evaporator and from rain condensation, thereby isolating said water from the electrical installation and thus avoiding possible short circuits.

The component seating means comprise a motor-fan support 12 and a ventilating chamber support 13.

The motor-fan support 12 is in the form of a substantially frusto-pyramidal rectangular body, the motor-fan 60 being attached onto the smaller upper face 12*a* of said support 12 through a supporting arm 61, which couples the latter to said motor-fan 60. In another embodiment, which is not illustrated, the motor-fan support may have a parallelepipedic, frusto-conical or any other frusto-pyramidal or frusto-prismatic form with any regular or irregular polygonal section, provided that it defines an adequate support and retention for the motor-fan, which can be secured directly to the support, or through a supporting arm.

The ventilating chamber support 13 is in the form of a substantially parallepipedic body, with its upper face being longitudinally concave, defining a curved arch, and which is provided at each longitudinal end with a ring fitting means 13*a*, in the form of a transversal groove, into which there will be fitted a respective end 73, which is bent in the form of a lug, belonging to a larger portion of a ventilating chamber ring 71, which, together with the curved arch of the ventilating chamber support 13, completes the ring 71. The attachment of the latter is due to the attachment of the ventilating chamber 70 to the base 10, preferably through bolting.

The evaporator water collector 21 of the draining system 20 presents, in its preferred construction, the form of a container with a substantially rectangular section, and whose sides are defined respectively by portions of the front and lateral walls of the base 10, and by portions of the rib 11 opposed to said base 10, the rib portion opposed to the front wall of the base 10, i.e., the rear wall of the evaporator water collector 21, being interrupted adjacent to the lateral wall of the base 10, in order to provide a water outlet 25 for said collector 21. The internal dimensions of said evaporator water collector 21 are substantially equal to the external dimensions of the evaporator bottom 30, so that the latter can be fitted in the former, this resource guaranteeing a perfect positioning for the assembly of said evaporator 30.

In another construction, which is not illustrated, the evaporator water collector 21 may assume various shapes, provided that it allows the correct positioning for the assembly of the evaporator 30.

In order to permit the removal of the set for attaching the mounting components of the external case, and for the maintenance of the appliance, the front wall of the base 10 is provided, at its median region, with a forwardly projected portion, defining a handle 14. This handle projects in such a way as to present a vertical transversal section in the form of an "L", with its smaller horizontal leg disposed at a level slightly superior relative to the level of the evaporator water collector 21, thereby preventing the user's hand from touching the water contained in said collector 21.

The water draining duct 22 (of the draining system 20), which extends in a slanted way from the water outlet 25 of the collector 21, at an upper level, towards the rear portion of the base 10, at a lower level, presents the form of a channel, which is defined, at one side, by the lateral wall of said base 10 and, at the other side, by a step 28 and the rib 11, and which is formed due to the difference of level of said duct 22, and projecting parallel to and spaced from said lateral wall, till it reaches the rear portion of the base 10.

In order to provide a perfect water drainage, the water draining duct 22 presents the outlet of the evaporator water collector 21 downwardly extended towards the rear portion of said base 10, reaching the end rear portion of the latter at a level lower than to the general level of the base 10.

At the end rear portion of the base 10, the draining system 20 further includes a condenser water collector 23, which presents, in the preferred construction, the form of a substantially rectangular container of flat bottom, delimited at the rear portion, by the rear wall of the base 10; at the front portion, by the step 28, defined by the difference of level formed between the rear and end rear portions of said base 10; at both sides, by a wall portion 27, incorporated to the rear portion of said step 28 and projecting partially towards the rear wall of the base 10, in order to define between the free end thereof and through a positioning means of said rear wall, an outlet channel 22*a*.

As described above, the draining system 20, besides providing the total and immediate drainage of all the pluvial and condensation water from the evaporator 30, collecting it in the condenser water collector thereof, allows that, due to the recessed disposition of said collector 23, the condenser 40, which is mounted to the rear portion of the base 10, is be kept with its lateral portions 41 constantly out of the water, although there is a permanent layer of water at the bottom of said collector 23. In such situation, the condenser 40 is not subjected to corrosion, in spite of the provision of said water layer, which refrigerates the bottom region of the condenser. Such construction provides the condenser with a substantially increased service life, besides guaranteeing a high thermal efficiency.

The draining system 20 of the present invention is further provided with a drain 24, which is substantially cylindrical, comprising a single piece with the base 10 and which is not necessarily disposed at the median region of the rear wall of said base 10, in order to drain all the water collected in the condenser water collector 23, at a height that is smaller or equal to the base 10, thus avoiding the inundation of said base 10.

In order to break the surface tension of the water, avoiding the overflow at the condenser water collector 23, there is incorporated in the base 10 a longitudinal vane 26 provided at the internal lower surface of the drain 24, said longitudinal vane 26 radially projecting towards the geometrical axis of said drain 24 and presenting an upper longitudinal face in the form of a wedge.

In another embodiment, which is not illustrated, the drain may assume a polygonal form, which may be regular or irregular, oblong or any other form, wherein the vane thereof can be projected in any direction, provided that adequate water drainage is assured from the condenser water collector, In order to allow a perfect positioning for the assembly of the condenser 40, there is provided the condenser tube positioning 27, which is defined by a rib portion incorporated t the rear portion of the step 28 and provided with recess, in order to receive at a predetermined position, the tubes 42 of the condenser 40, such solution guaranteeing the adequate positioning of said condenser 40, in order to allow the posterior steps in the assembly of the appliance.

There are further provided preferably three compressor spacing elements 51, in the form of substantially frusto-conical studs, into which respective bolts for attaching the compressor 50 are internally fitted, the rubber dampers of said compressor 50 being externally fitted into said elements 51. Such construction allows the bolting of the compressor 50, said spacing elements 51 avoiding the denting of the rubber damper 80, thus increasing the useful life of said compressor.

I claim:

1. Set for attaching air conditioner components comprising:

a single piece molded plastic base having integrally formed thereon a plurality of raised ribs disposed on the surface of said base to which air conditioner components are to be attached;

component seating means of solid construction including a motor-fan support of a substantially rectangular frusto-pyramidal body, the motor-fan to be seated and attached onto the smaller base of said frusto-pyramidal support, and a ventilating chamber support of a substantially parallepipedic body with a longitudinally concave upper face forming a curved arch and provided at each longitudinal end with a ring fitting means for the fitting of a respective end of a ventilating chamber ring;

water draining means;

a single piece means for positioning and mounting a condenser; and a compressor spacing means disposed to receive and retain a compressor attaching element.

2. A set according to claim 1, wherein said water draining means comprise:

an evaporator water collector in the form of a substantially rectangular container with its sides being defined by portions of upwardly extending lateral and front walls of said base and said raised ribs opposite to said wall portions;

a water draining duct slantedly extended throughout said base between said evaporator water collector and a rear portion of said base and which leads the water from said evaporator water collector to said base and limited on one side by one upwardly extending lateral wall of said base and on the other side by the lateral upwardly extending portion of said step on said base and a portion of a said raised rib, said step and said raised rib portions being formed of different heights and projecting parallel to and spaced from said one lateral wall; and a drain incorporated to a rear wall of said base.

3. A set according to claim 1, wherein said ring fitting means has transversal grooves to receive respective ends of the ventilating chamber ring in the form of respective lugs.

4. A set according to claim 2, wherein the rear wall of said evaporator water collector has an interruption adjacent to a lateral wall of the base, said interruption defining a water outlet for said evaporator water collector.

5. A set according to claim 2 wherein the water draining duct is a channel extending between the water outlet of said evaporator water collector and the rear portion of said base, said channel reaching the end rear portion of the base at a level lower than the general level of said base.

6. A set according to claim 2, wherein said base includes at the rear portion thereof a condenser water collector in the form of a substantially rectangular container having a flat bottom and which is delimited at its rear portion by the rear wall of the base, at at its front portion by the rear portion of said step, and on both sides by a wall portion which is orthogonally incorporated to the rear portion of said step and which partially projects towards the rear wall of the base to form between the free end of said step and said base an outlet channel, said base further including a positioning mens for the condenser tube.

7. A set according to claim 2, wherein the positioning means of the condenser tubes comprises a rib portion incorporated orthogonally to the rear portion of said step, said positioning means being provided with a recess to receive in position the lateral tubes of the condenser.

8. A set according to claim 1, wherein said raised ribs are provided with reinforcing elements and perforations for the bolting of the air conditioner components.

9. A set according to claim 2, wherein the internal dimensions of the evaporator water collector are substantially equal to the external dimensions of the evaporator bottom.

10. Set for attaching air conditioner components comprising:

a single piece molded plastic base having integrally formed thereon a plurality of raised ribs to which components are to be attached, disposed on the surface of said base, component seating means of solid construction;

water draining means;

a single piece means for positioning and mounting a condenser;

a compressor spacing means disposed to receive and retain a compressor attaching element; and an integral handle having a forwardly projected portion provided at the middle of the base front wall and having a vertical transversal section in the form of an "L" with its smaller leg disposed in a level slightly higher relative to the level of a part of said water draining means.

11. A set according to claim 10 wherein the component seating means comprises:

a motor-fan support of a substantially rectangular frusto-pyramidan body, the motor-fan to be seated and attached onto the smaller base of said motor fan support; and a ventilating chamber support of a substantially parallepipedic body with a longitudinally concave upper face forming a curved arch and provided at each longitudinal end with a ring fitting means for the fitting of a respective end of a ventilating chamber ring.

12. A set according to claim 10, wherein the raised ribs further define reinforcing means and water retaining means of the base.

13. A set according to claim 10, wherein said part of said water draining means comprises: an evaporator water collector in the form of a substantially rectangular container with its sides being defined by portions of upwardly extending lateral and front walls of said base and said raised ribs opposite to said wall portions;

and said water draining means further comprises a water draining duct slantedly extended throughout said base between said evaporator water collector and the rear portion of said base and which leads water from said evaporator water collector to said base and limited on one side by one upwardly extending lateral wall of said base and on the other side by the lateral upwardly extending portion of a step on said base and said portions of said raised ribs, said step and said raised rib portions being formed of different heights and projecting parallel to and spaced from said one lateral wall; and a drain incorporated in the rear wall of said base.

14. A set according to claim 13 wherein the water draining duct is a channel extending between the water outlet of said evaporator water collector and the rear portion of said base, said channel reaching the end rear portion of the base at a level lower than the general level of said base.

15. Set for attaching air conditioner components comprising:

a single piece molded plastic base having integrally formed thereon a plurality of raised ribs disposed on the surface of said base to which air conditioner components are to be attached;

component seating means of solid construction including a motor-fan support of a substantially rectangular frusto-pyramidan body, a motor-fan to be seated and attached onto the smaller base of said support, and a ventilating chamber support of a substantially parallepipedic body with a longitudinally concave upper face forming a curved arch and provided at each longitudinal end with a ring fitting means for the fitting of a respective end of a ventilating chamber ring;

water draining means comprising respectively an evaporator water collector in the form of a substantially rectangular container with its sides being defined by portions of upwardly extending lateral and front walls of said base and by portions of said raised ribs opposite to said wall portions;

a water draining duct slantedly extended throughout said base between said evaporator water collector and the rear portion of said base and which leads the water from said evaporator water collector to said base and limited on one side by one upwardly extending lateral wall of said base and on the other side by the lateral upwardly extending portion of said step on said base and by portions of said raised ribs, said step and said portions of said raised ribs being formed of different heights and projecting parallel to and spaced from said one upwardly extending lateral wall;

a single piece means for positioning and mounting a condenser;

a compressor spacing means disposed to receive and retain a compressor attaching element; and a drain incorporated to the rear wall of said base having a longitudinal vane incorporated at its internal lower surface which radially projects towards the geometrical axis of said drain, the upper longitudinal face of said vane being in the form of a wedge.

* * * * *